US006167890B1

(12) United States Patent
Gueret

(10) Patent No.: US 6,167,890 B1
(45) Date of Patent: Jan. 2, 2001

(54) COSMETIC PACKAGE HAVING PERMEABLE ZONE

(75) Inventor: Jean-Louis Gueret, Paris (FR)

(73) Assignee: L'Oreal, Paris (FR)

( * ) Notice: Under 35 U.S.C. 154(b), the term of this patent shall be extended for 0 days.

(21) Appl. No.: 08/839,251

(22) Filed: Apr. 17, 1997

(30) Foreign Application Priority Data

Apr. 24, 1996 (FR) ..... 96-05154

(51) Int. Cl.[7] ..... A45D 40/00; B65D 71/00

(52) U.S. Cl. ..... 132/200; 132/293; 132/320; 206/229

(58) Field of Search ..... 206/229, 484, 206/524.2, 525.1, 581; 132/200, 293, 307, 320; 53/455

(56) References Cited

U.S. PATENT DOCUMENTS

| | | | | |
|---|---|---|---|---|
| 1,149,946 | * | 8/1915 | Potter | 206/229 |
| 2,209,914 | * | 7/1940 | Gerber et al. | 206/229 |
| 2,576,550 | * | 11/1951 | Waters | 206/229 |
| 2,576,551 | * | 11/1951 | Waters | 206/229 |
| 2,695,704 | * | 11/1954 | McGredy | 206/229 |
| 2,889,922 | * | 6/1959 | Clarvoe | 206/484 |
| 3,246,444 | | 4/1966 | Paisley . | |
| 3,334,804 | | 8/1967 | Watts . | |
| 3,362,776 | * | 1/1968 | Knorr | 206/229 |
| 3,635,567 | * | 1/1972 | Richardson, Jr. | 206/229 |
| 4,127,339 | | 11/1978 | Malacheski et al. . | |
| 4,269,527 | | 5/1981 | Lipfert et al. . | |
| 4,526,273 | | 7/1985 | Tsuji et al. . | |
| 4,840,270 | | 6/1989 | Caputo et al. . | |
| 5,373,966 | * | 12/1994 | O'Reily et al. | 206/484 |
| 5,380,110 | | 1/1995 | Festa . | |

FOREIGN PATENT DOCUMENTS

| | | |
|---|---|---|
| 295 02 988 U | 4/1995 | (DE) . |
| 291284 | 11/1988 | (EP) . |
| 1414936 | 9/1965 | (FR) . |
| 2062956 | 7/1971 | (FR) . |
| 14582162 | 12/1976 | (GB) . |
| 2217299 | 10/1989 | (GB) . |

* cited by examiner

*Primary Examiner*—Todd E. Manahan
(74) *Attorney, Agent, or Firm*—Oliff & Berridge, PLC

(57) ABSTRACT

The invention relates to a packaging bag for packaging a pasty product, in particular a cosmetic. The bag comprises at least one front sheet and a back sheet that are assembled together so as to contain said product in the form of a thin layer that is spread out between said sheets, the front sheet at least being flexible and also having a zone that is permeable to said product, the flexibility of the front sheet being selected in such a manner as to enable it to be pressed against the back sheet by means of a finger or of an applicator firstly to enable the user to take off the product, and secondly to enable the bag to be emptied completely.

62 Claims, 5 Drawing Sheets

COSMETIC PACKAGE HAVING PERMEABLE ZONE

BACKGROUND OF THE INVENTION

There exist pasty compositions for use in makeup that need to be extruded through dies of large diameter because of their high viscosity.

It is known to package such pasty compositions in pots or in depressions in a case or "compact", where the opening for inserting the substance is large enough to enable filling to be performed at a high rate by means of an extrusion die.

OBJECTS AND SUMMARY OF THE INVENTION

The invention relates to a novel type of packaging for a product of creamy to pasty consistency.

More particularly, the invention seeks to provide a bag for packaging a product of creamy to pasty consistency, the bag comprising at least a front sheet and a back sheet which are assembled together so as to contain said product in the form of a thin layer spread out between said sheets, the front sheet at least being flexible and also having a zone that is permeable to said product, the flexibility of the front sheet being selected in such a manner as to enable it to be pressed against the back sheet by means of a finger or of an applicator, thereby making it possible firstly for the user to extract product, and secondly to ensure that the bag can be emptied completely.

The permeability to the product of the front sheet through which the product is dispensed can be obtained by means of multiple perforations through the sheet or by making said sheet out of a porous material that is woven or non-woven or spongy or sintered.

It is also possible to make said permeable zone by superposing a perforated film on a film of porous material that is woven or non-woven or spongy or sintered.

The user can take the product contained in the bag by wiping a finger over the front sheet, or by using an applicator.

The front sheet may be made of a flexible material, giving the user a soft-touch feel.

Also, the user can take exactly the necessary quantity of product by pressing the front sheet against the back sheet which may be rigid, semi-rigid, or flexible in which case it must be resting against a rigid surface, whereas taking just the right amount is not always possible when the product is packaged in a pot and the product itself is either very adhesive or else hardly adhesive at all.

In the first case the product tends to adhere as a lump on the user's finger, thus making it difficult to extract a small quantity only of product from the pot.

On the contrary, if the product hardly adheres at all, and has a tendency to form clumps without sticking to the user's finger, then it is difficult to extract the product cleanly.

By means of the invention, it is possible to package a product of creamy to pasty consistency even if it is very adhesive or hardly adhesive at all, without encountering the drawbacks of packaging such a product in a pot.

The invention thus makes it possible to package a very wide range of products.

In a particular embodiment of the invention, the front and back sheets are substantially plane and are assembled to each other so that once the bag has been completely emptied, the bag is plane and said sheets are in contact with each other over a major portion of their area.

Advantageously, the sheet which is permeable to the product is covered in a peel-off film to prevent the product escaping and to guarantee that it is preserved from coming into contact with air until first use.

In a particular embodiment of the invention, the front sheet, which is permeable to the product, is covered by a mask having a central opening.

Advantageously, said mask is constituted by a rigid frame.

The bag may advantageously be used as a refill in a makeup case.

The invention thus also provides a makeup case including a receptacle having a bottom and receiving a bag as specified above, the back sheet resting on said bottom.

In a particular embodiment of said case, the bottom of said receptacle is rigid and the back sheet of the bag is flexible and rests against said bottom.

In another particular embodiment of said case, said receptacle is constituted by a drawer making it possible, when extracted from the case, to insert or replace the bag.

The invention also provides a method enabling a bag to be manufactured for packaging a product of creamy to pasty consistency, and more particularly a product that is very viscous.

The method comprises the following steps:

forming a sandwich comprising a mass of the product spread out between two sheets, at least one of which is flexible and one of which is permeable to said product or is suitable for becoming permeable thereto;

compressing said sandwich along at least one closure line so as to bring said sheets together; and bonding said sheets together along said closure line.

Advantageously, said mass of product is spread out by pressing the sheets against each other.

In a particular embodiment, the bag includes a sheet which is perforated at least in its central region and which is covered over its perforated region by a removable film.

The mass of product may be deposited on one of the sheets and then covered by the other sheet.

In a variant, the two sheets are preassembled to form a pocket into which a large-diameter nozzle can be inserted for injecting the product.

Advantageously, the sheets are preassembled so as to form a funnel outside said pocket, thereby facilitating insertion of the filler nozzle.

After the pocket has been filled, the side through which the filler nozzle was inserted is closed and the funnel is cut off, thereby forming said bag.

BRIEF DESCRIPTION OF THE DRAWINGS

Other characteristics and advantages of the present invention appear on reading the following detailed description of non-limiting embodiments of the invention and on sight of the accompanying drawings, in which.

MORE DETAILED DESCRIPTION

Figure 1:
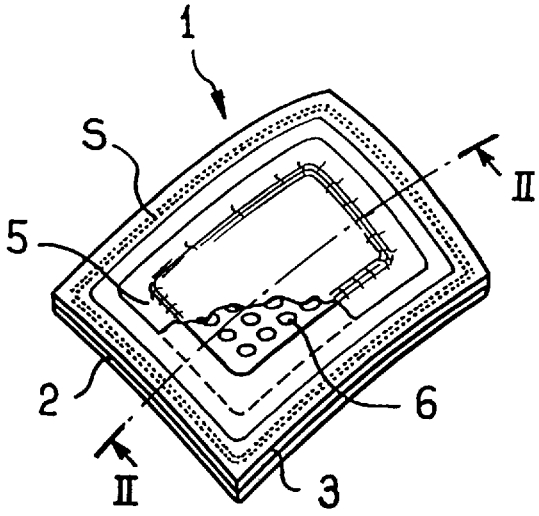
FIG. 1 is a partially cutaway diagrammatic perspective view of a packaging bag constituting an embodiment of the invention.

FIG. 1 shows a packaging bag 1 constituting a first embodiment of the invention.

In the example described, this bag 1 has a rectangular outline and its top and bottom faces are generally outwardly convex.

In the example described, the bag 1 is made by assembling together two independent flexible sheets 2 and 3 along a bonding line S extending along the margins of the four sides of the bag over a width e.

The top sheet 3 which is to face the user when the bag is in use, is referred to below as the "front" sheet, while the bottom sheet 2 which rests on a plane or slightly curved surface while in use is referred to as the "back" sheet.

In a variant, the bag may be made from a flexible strip that is folded over, in which case the two sheets are already joined together along one side before being assembled together along the remaining three sides.

In another variant, the bag may be formed by assembling together a flexible sheet and a sheet that is relatively rigid, e.g. a sheet of plasticized card or a thin plate of rigid plastics material.

The bag 1 contains a mass of a product 4 of creamy to pasty consistency, and the front sheet 3 has a central region that is permeable to the product.

Advantageously, at least the front sheet 3 is transparent so as to enable the user to see the product contained inside the bag.

In the example described, the front sheet 3 is perforated in its central region like a sieve so as to allow the product to be dispensed through multiple small-diameter perforations 6. Up to first use, this perforated region is covered on the outside by a removable closure film 5, e.g. constituted by an adhesive film.

The front sheet 3 may be perforated over its entire area, or in its central region only.

Advantageously, a centrally-perforated mask may be applied to the front sheet 3 for the purpose of masking the zone where the sheets 2 and 3 are assembled together, and possibly also serving to define accurately the zone through which the product is dispensed and serving to carry the removable film 5.

Such a mask may be made in the form of a relatively rigid frame, in the manner described below.

The flexibility of the front sheet 3 makes it possible to empty the packaging bag completely through the perforations in the front sheet 3 by pressing the sheets 2 and 3 one against the other, with the back sheet 2, if a flexible sheet, resting against a rigid surface such as the bottom of a receptacle, as explained in greater detail below.

The sheet 3 may advantageously be shaped in such a manner as to take up a shape that bulges slightly outwards while the sheet is at rest, thereby separating itself from the mass of product contained inside the bag.

The product is in the form of a thin layer between the sheets 2 and 3.

The thickness of the product is substantially constant or slightly greater in the middle of the bag, preferably lying in the range 1 mm to 6 mm, and more preferably in the range 2 mm to 4 mm.

Thus, the thickness of the product is, for example, 0.5 mm in the vicinity of the periphery and it lies in the range 2 mm to 4 mm in the vicinity of the middle of the bag.

The thickness of the sheet 3 which is permeable to the product lies in the range 5 $\mu$m to 1 mm, preferably in the range 40 $\mu$m to 500 $\mu$m, and more preferably in the range 100 $\mu$m to 300 $\mu$m.

The sheets 2 and 3 may be made of the same material or they may be made of different materials.

It is thus possible, in non-limiting manner, to make the packaging bag 1 out of polyethylene (PE), out of polyvinyl chloride, out of polyethylene terephthalate (PET), or out of a PE/PET copolymer.

It is also possible to make the packaging bag 1 by using sheets each constituted by a laminate, e.g. of polyethylene terephthalate and aluminum, or of polyethylene terephthalate and polyethylene.

The use of multilayer films for making the bag can be useful in preventing certain components of the packaged product escaping to the outside through the walls of the bag while it is not in use.

Figure 2:
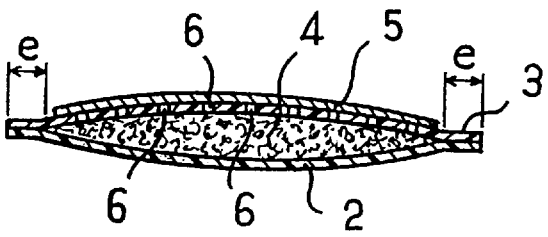
FIG. 2 is a diagrammatic view on section line II—II of FIG. 1.

The region which is permeable to the product may be made, as shown in FIGS. 1 and 2 for example, merely by perforations through the top sheet 3, with the diameter and the number of such perforations being selected as a function of the nature of the product to be packaged and dispensed, and as a function of the conditions under which the bag is to be used.

In a variant, the top sheet 3 can be made of a material that is intrinsically permeable to the product to be packaged and dispensed, such as a material that is woven or non-woven or spongy.

Figure 18:
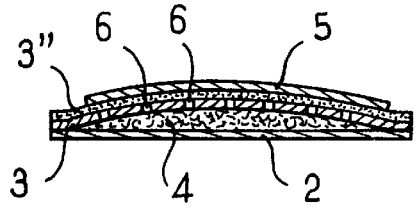
FIG. 18 is a diagrammatic section view of a packaging bag constituting a variant embodiment of the invention.

In another variant, as shown in FIG. 18, it is possible to make the region which is permeable to the product by superposing a perforated film 3 suitable for allowing the product to pass through its perforations and a porous film 3" of woven or non-woven or spongy material extending over said perforations and intended, for example, to ensure that the product is distributed more uniformly or to modify the "feel" thereof. The porous film 3" may extend over the entire area of the perforated film or over only the perforated region thereof.

FIGS. 3 to 7 show various steps in a first method of making the packaging bag 1.

Figure 3:
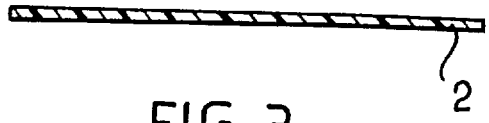
FIGS. 3 to 7 show various steps in a first method of making a packaging bag of the invention.
Figure 4:
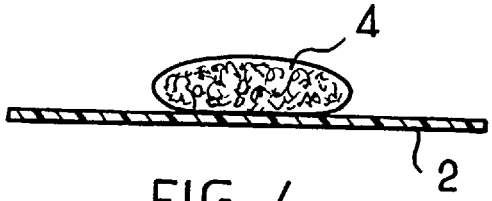

As shown in FIGS. 3 and 4, the mass of product 4 is deposited in the middle of the top face of the back sheet 2, with the product being dispensed from a large-diameter extrusion die (not shown).

Figure 5:
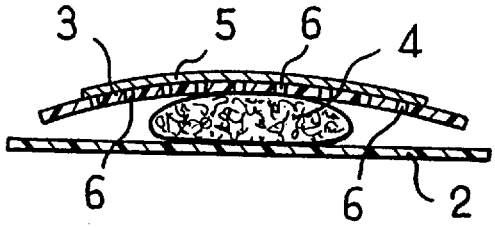

The front sheet 3 provided with its removable film 5 is then placed over the mass of product 4 as shown in FIG. 5, said sheet being large enough to cover the product.

Figure 6:
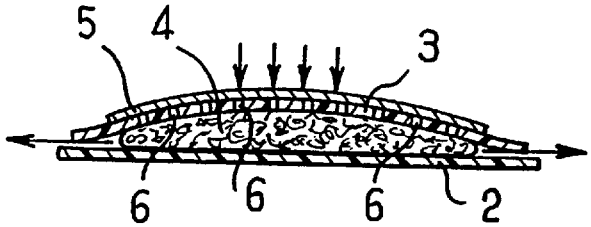

Thereafter, as shown in FIG. 6, the front sheet 3 is pressed against the back sheet 1 resting against a rigid plane surface so as to spread out the mass of product 4 and form a sandwich having a thin layer of paste spread between the sheets 2 and 3.

Figure 7:
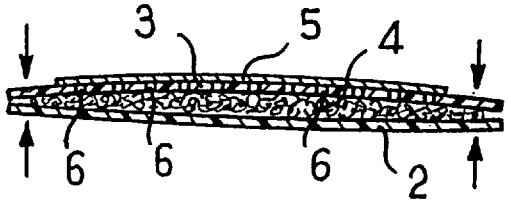
Figure 8:
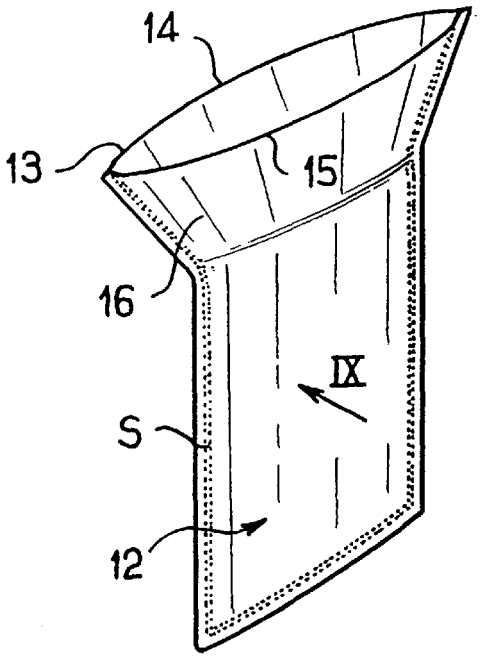
FIG. 8 is a diagrammatic perspective view of a pocket used in a second implementation of the method for making a packaging bag of the invention.

After it has been spread out, the mass of product 4 is of substantially uniform thickness over the entire inside surface between the sheets 2 and 3, as shown in FIG. 7.

The sheets 2 and 3 are then pressed against each other around their periphery over a margin of width e from their outer edges, and the regions of the sheets which are brought together in this manner are then bonded together around four sides through a residual thickness of the product, by any conventional technique, thereby forming the bag 1.

Suitable bonding means include, for example, ultrasound or high frequency heat sealing.

The protective film 5 serves to close the bag 1 hermetically until it is used.

After the film has been removed, the user can take away product through the perforations 6 of the front sheet 3.

There follows a description of a second implementation of the method for making the packaging bag 1, given with reference to FIGS. 8 to 15.

The method starts with a pocket 12 that is open at the top 13.

The pocket 12 is made of flexible plastics material, of the same kind as that used for making the sheets 2 and 3 in the above implementation.

The pocket 12 is obtained by bringing two same-shaped sheets 14 and 15 face to face towards each other and by sealing them together around their periphery, along three sides only.

In a variant, the pocket 12 may be made by folding a single flexible strip in half, in which case it is necessary to heat-seal two sides only.

The pocket 12 has perforations and a removable film on one of its main faces, which are not shown in order to clarify the drawing.

The pocket 12 is rectangular at its bottom end while its open top end flares to form a funnel 16 that is intended to facilitate inserting a product filler nozzle into the pocket.

Bonding lines S between the sheets 14 and 15 are represented by dashed lines.

Figure 9:
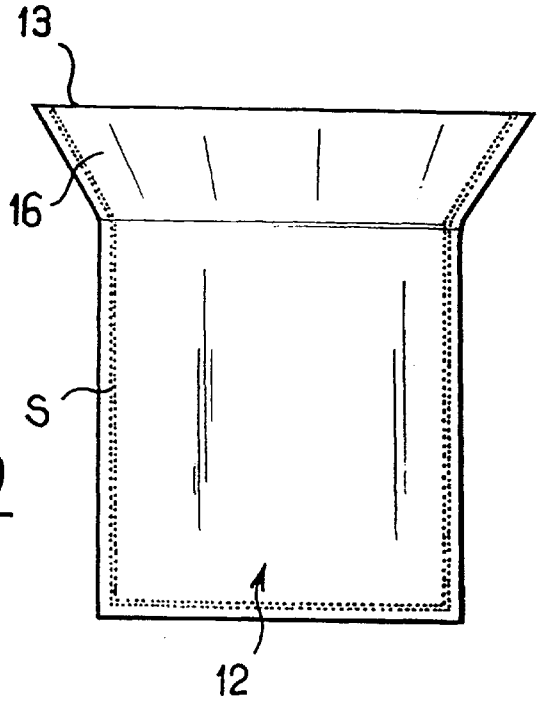
FIG. 9 is a front elevation view as seen along arrow IX of FIG. 8.
Figure 10:
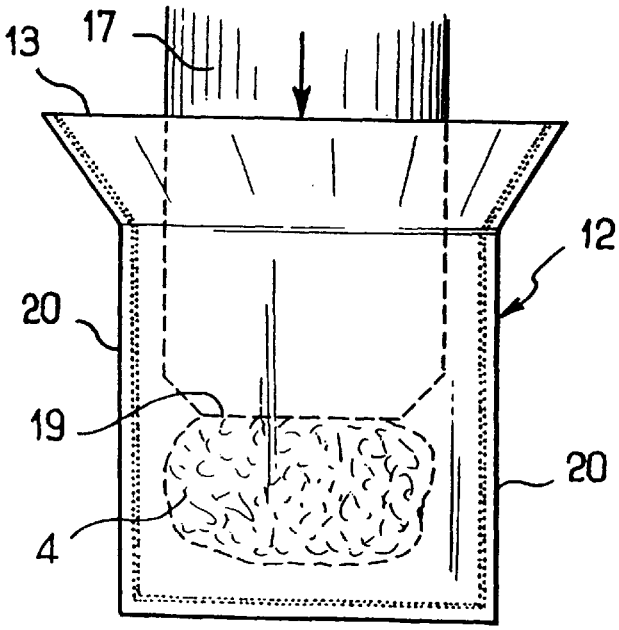
FIGS. 10 and 11 are front elevation views respectively during and after filling of the pocket.

The elevation of FIG. 9 shows the pocket 12 prior to being filled, where filling is performed by means of a large-diameter nozzle 17 inserted through the top end 13 so as to deliver a mass of product 4 to the bottom of the inside of the pocket via an orifice 19. While the product is being dispensed, the orifice 19 is situated about halfway up the parallel sides 20 of the bottom portion of the pocket 12.

Figure 11:
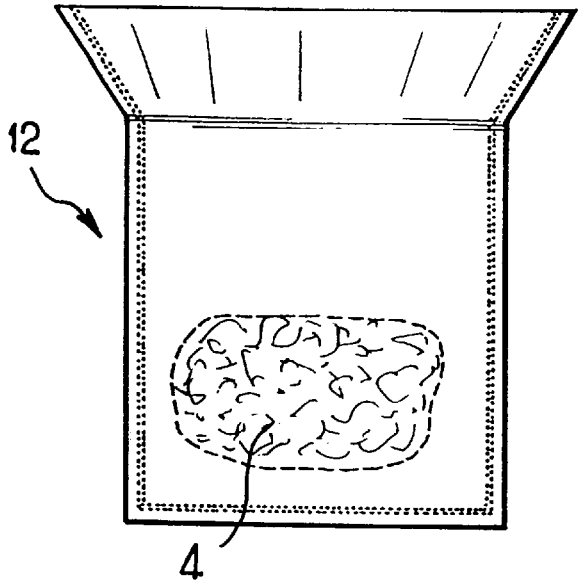

FIG. 11 shows the pocket 12 after the filler nozzle 17 has been removed.

Figure 12:
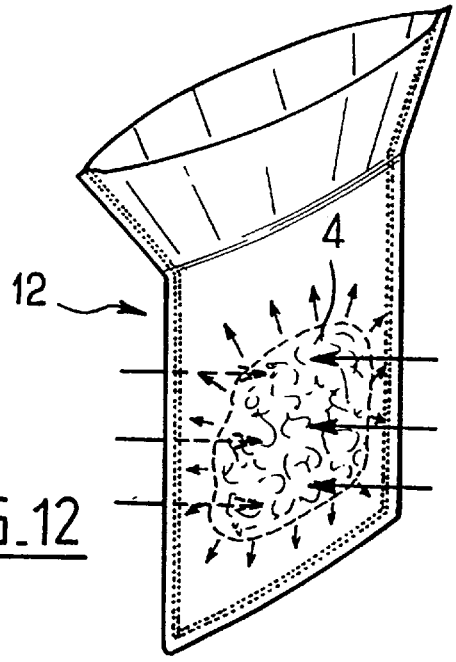
FIG. 12 is a diagrammatic perspective view showing how the mass of product is spread out inside the pocket.

The mass of product 4 is then spread out by pressing the two main faces of the pocket 12 towards each other, as shown in FIG. 12.

Figure 13:
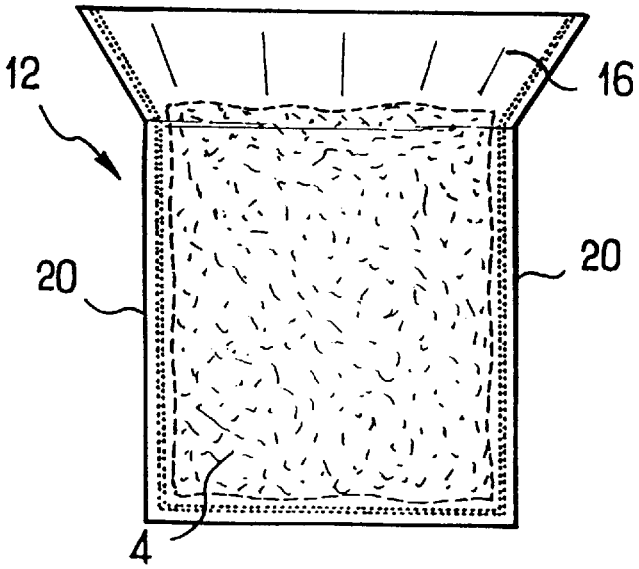
FIGS. 13, 14, and 15 are front elevation views respectively showing the pocket after the mass of product has been spread out, after the pocket has been closed, and after the funnel-forming top portion has been cut off.

On being spread out, the mass of product 4 moves upwards into the bottom of the funnel 16, i.e. above the top ends of the sides 20 of the bottom portion of the pocket, as shown in FIG. 13.

Figure 14:
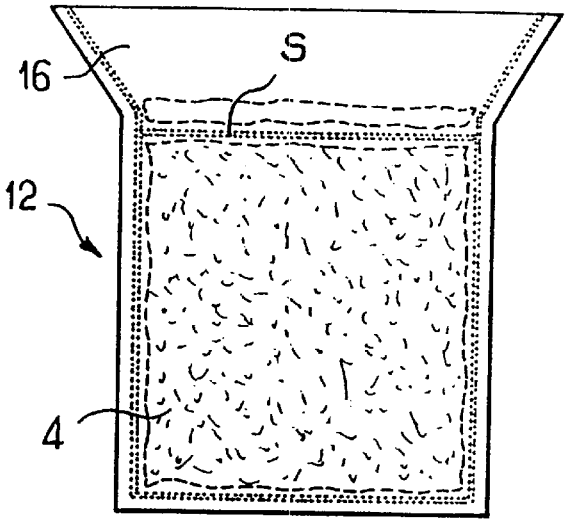
Figure 15:
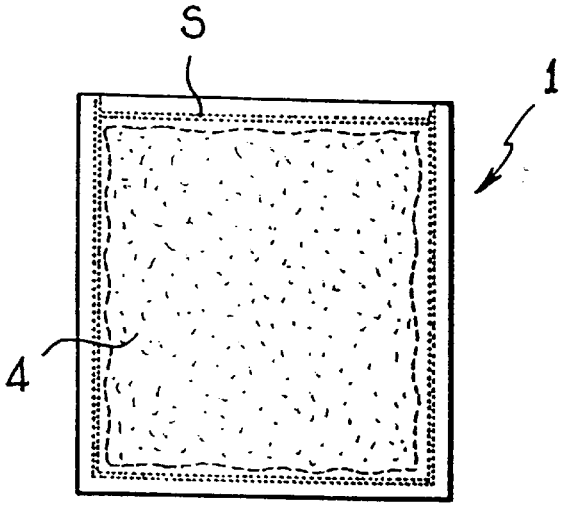

The pocket 12 is then sealed after the sheets 14 and 15 have been moved towards each other, with sealing taking place along a closure line running between the top ends of the sides 20, and acting through a residual thickness of the product, as shown in FIG. 14.

Thereafter, the pocket 12 is cut along a line parallel to the last-sealed line so as to cut off the funnel 16 from the remainder of the pocket which then forms a packaging bag identical to the above-described bag 1 even though it has been filled in different manner.

As mentioned above, a mask can be applied to the two assembled-together sheets for holding back the product.

Figure 16:
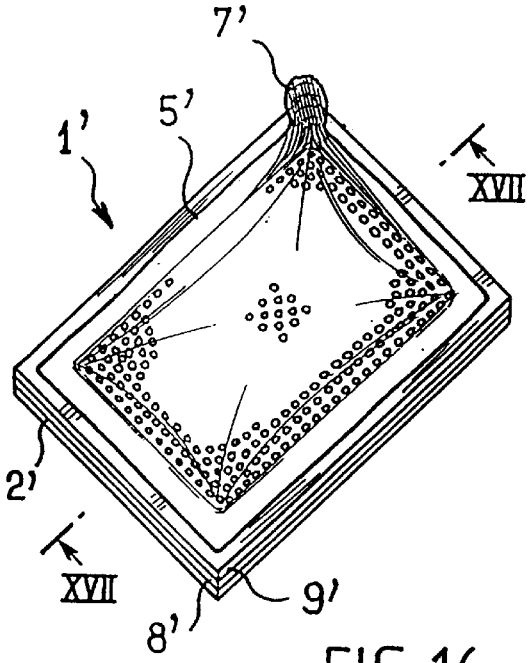
FIG. 16 is a diagrammatic perspective view of a variant embodiment of a packaging bag.
Figure 17:
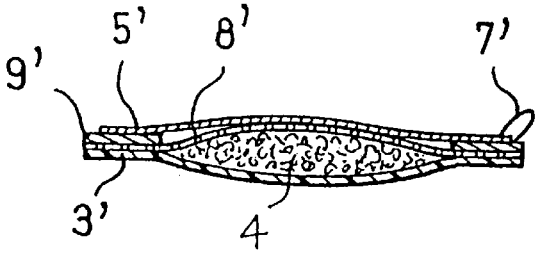
FIG. 17 is a diagrammatic section on section line XVII—XVII of FIG. 16.

FIGS. 16 and 17 show a bag 1' comprising a back sheet 3', a perforated front sheet 8', a mask 9', and a removable protective film 5' that is provided with a tongue 7' suitable for being grasped.

The sheets 3' and 8' are assembled together to contain the product 4. The mask 9' has a central opening to allow the user to take product off by passing a finger or an applicator over the front sheet 8' after removing the removable film 5'. The periphery of the removable film is fixed to the outside face of the mask 9'. The front face 8' is pierced by perforations that are uniformly distributed over its entire area.

The mask 9' may be bonded to the front sheet 8' while the front sheet is being bonded to the back sheet 3', and it may be made of a plastics material that is relatively rigid and opaque, so as to make the bag easier to handle and so as to make the bag agreeable in appearance. In a variant (not shown) it is possible to make use of two frame-forming elements of relatively rigid plastics material that are superposed and assembled together over the outline of the flexible sheets, thereby holding and masking them like a frame holds and masks a photographic slide. Before assembly, the two elements may be independent or they may be connected together via a film hinge, and only one of the elements needs to have an opening to enable the user to take the product.

Figure 19:
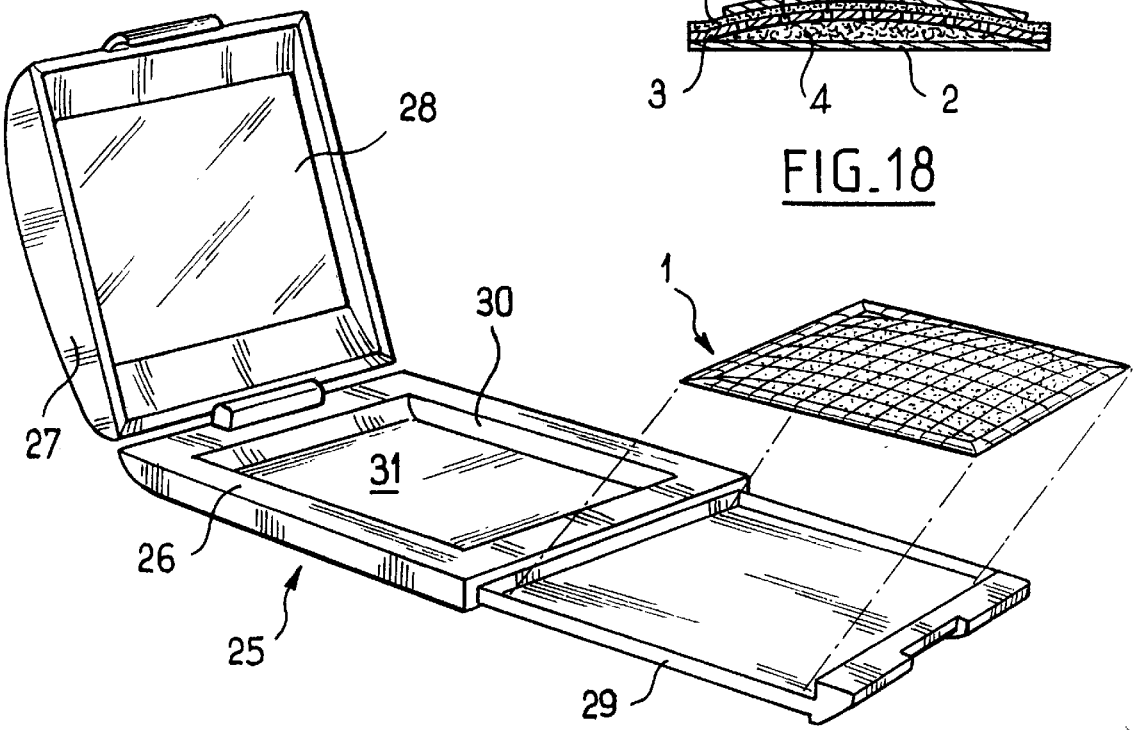
FIG. 19 is a diagrammatic perspective view of a makeup case containing a packaging bag constituting an embodiment of the invention.

The bag 1 or 1' may advantageously be used in a makeup accessory 25 as shown diagrammatically in perspective in FIG. 19.

The accessory 25 comprises a case 26 provided with a hinged lid 27 which may have a mirror 28 in the bottom thereof.

The body of the case 26 houses a sliding drawer 29 which has a rigid bottom 33 and which is capable of being pulled out from the case to receive a bag 1 or 1' of corresponding size.

Once the drawer 29 has been put back into place in the body of the case 26, the bag 1 or 1' is held by a frame 30 that defines access 31 to the top face of the bag.

The product is taken by means of a finger or an applicator 32 being brought into contact with the permeable region of the front sheet 3 once the protective film 5 has been removed.

Figure 20:
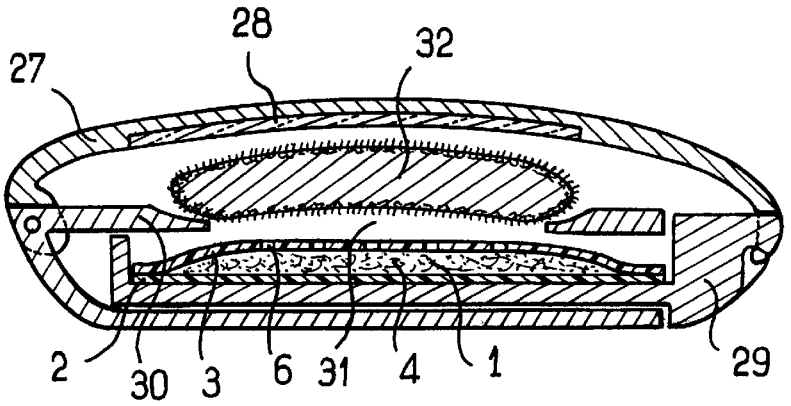
FIG. 20 is a section view on a midplane through the case shown in FIG. 19 while in its closed state.

Advantageously, as shown in FIG. 20, the applicator 32 is housed inside the accessory 25 while it is not in use between the frame 30 and the lid 27 which is folded down onto the body of the case.

The flexibility of the front sheet which is permeable to the product makes it possible to empty the bag completely by pressing against the back sheet. The two sheets are then in contact one against the other over the major portion of their area.

The invention thus makes it possible to package an expensive product without losing any of the product for the user.

Naturally, the invention is not limited to the embodiments described above.

In particular, the shape of the bag can be modified to take up a shape that is not rectangular, but that is circular, for example.

Also, the bag need not be received in a sliding drawer, but may merely be received in a slot in the case of a makeup accessory similar to that described above.

The bag may also serve as sample for inserting in printed magazines or for sending by post, enabling the product contained therein to be tried out.

What is claimed is:

1. A packaging bag filled with a pasty product, the bag comprising at least a front sheet and a back sheet which are assembled together so as to contain the product in the form of a thin layer spread out between said sheets such that said front sheet contacts said product, the front sheet at least being flexible and also having a zone including openings that render said zone permeable to the product, the flexibility of the front sheet being selected in such a manner as to enable it to be pressed against the back sheet by means of a finger or of an applicator, thereby making it possible firstly for the user to extract product through said openings substantially without changing the size of said openings, and secondly to ensure that the bag can be emptied completely.

2. A packaging bag according to claim 1, wherein said front and back sheets are substantially plane and are assembled to each other in such a manner that after the bag has been emptied completely, the bag is plane and said sheets are in contact with each other over a major portion of their area.

3. A packaging bag according to claim 1, wherein said back sheet is constituted by a sheet of plasticized card or a thin plate of rigid plastics material.

4. A packaging bag according to claim 1, wherein the front sheet is made of a transparent plastics material.

5. A packaging bag according to claim 1, wherein the front sheet is made by superposing a porous film and a perforated film.

6. A packaging bag according to claim 1, wherein the front sheet is covered by a mask having a central opening.

7. A packaging bag according to claim 6, wherein said mask is constituted by a rigid frame.

8. A packaging bag according to claim 7, wherein the zone permeable to the product is covered, prior to use of the bag, by a removable protective film fixed on said mask.

9. A packaging bag according to claim 1, including multiple small-diameter perforations in said zone permeable to the product.

10. A packaging bag according to claim 1, including, in said zone permeable to the product, a material that is woven or non-woven or spongy or sintered.

11. A packaging bag according to claim 1, wherein the sheet having said zone permeable to the product is shaped to be outwardly curved when at rest.

12. A makeup case comprising a receptacle having a rigid bottom, wherein said receptacle houses a packaging bag as defined in claim 1, the back sheet of the bag being flexible and resting on said rigid bottom.

13. A makeup case comprising a receptacle having a bottom, wherein said receptacle houses a packaging bag as defined in claim 1, the back sheet thereof resting against said bottom.

14. A case according to claim 13, wherein said receptacle is formed by a drawer making it possible, when the drawer is pulled out from the case, to insert or replace a bag.

15. A method of manufacturing a bag for containing a pasty product, the method comprising:

forming a sandwich comprising a mass of the pasty product spread out between a front sheet and a back sheet, at least the front sheet being flexible and permeable to said product;

compressing said sandwich along at least one closure line so as to bring said sheets together; and bonding said sheets together along said closure line to form said bag;

said bag comprising at least the front sheet and the back sheet assembled together so as to contain the product in the form of a thin layer spread out between said sheets such that said front sheet contacts said product, the front sheet having a zone including openings that render said zone permeable to the product, the flexibility of the front sheet being selected in such a manner as to enable it to be pressed against the back sheet by means of a finger or of an applicator, thereby making it possible firstly for the user to extract product through said openings substantially without changing the size of said openings, and secondly to ensure that the bag can be emptied completely.

16. A method according to claim 15, wherein said mass of product is spread out by pressing the sheets against each other.

17. A method according to claim 15, wherein the mass of product is deposited on one of the sheets which serves as a support therefor, and is subsequently covered by the other sheet.

18. A method according to claim 15, wherein the two sheets are preassembled so as to form a pocket suitable for receiving a filler nozzle for enabling the pocket to be filled with the product.

19. A method according to claim 18, wherein the sheets are preassembled so as to form a funnel facilitating insertion of said filler nozzle, after which the pocket is sealed along the side through which the filler nozzle was inserted and the funnel is cut off so as to form the bag.

20. A method according to claim 15, wherein the two sheets are obtained by folding a strip of material in half.

21. A packaging bag filled with a pasty product, the bag comprising at least a front sheet and a back sheet which are assembled together so as to contain said product in the form of a thin layer spread out between said sheets, the front sheet at least being flexible and also having a zone that is permeable to said product, the flexibility of the front sheet being selected in such a manner as to enable it to be pressed against the back sheet by means of a finger or of an applicator, thereby making it possible firstly for the user to extract product, and secondly to ensure that the bag can be emptied completely, wherein the front sheet is covered by a rigid frame fixed relative to said front sheet and having a central opening.

22. A packaging bag filled with a pasty product, the bag comprising at least a front sheet and a back sheet which are assembled together so as to contain said product in the form of a thin layer spread out between said sheets, the front sheet at least being flexible and also having a zone that is permeable to said product, the flexibility of the front sheet being selected in such a manner as to enable it to be pressed against the back sheet by means of a finger or of an applicator, thereby making it possible firstly for the user to extract product, and secondly to ensure that the bag can be emptied completely, wherein said front and back sheets are welded through a layer of said product.

23. A packaging bag filled with a pasty product, the bag comprising at least a front sheet and a back sheet which are assembled together so as to contain said product in the form of a thin layer spread out between said sheets, the front sheet at least being flexible and also having a zone that is permeable to said product, the flexibility of the front sheet being selected in such a manner as to enable it to be pressed against the back sheet by means of a finger or of an applicator, thereby making it possible firstly for the user to extract product, and secondly to ensure that the bag can be emptied completely, wherein the front sheet has at least in the center a permeable zone made by multiple small diameter perforations which are open at rest.

24. A packaging bag filled with a pasty product, the bag consisting of a front sheet and a back sheet which are assembled together so as to contain the product in the form of a thin layer spread out between said sheets, the front sheet at least being flexible and also having a zone that is permeable to the product, the flexibility of the front sheet being selected in such a manner as to enable the front sheet to be pressed against the back sheet by means of a finger or of an applicator, thereby making it possible firstly for the user to extract product, and secondly to ensure that the bag can be emptied completely.

25. A packaging bag according to claim 24, wherein the front and back sheets are substantially plane and are assembled to each other in such a manner that after the bag has been emptied completely, the bag is plane and the front and back sheets are in contact with each other over a major portion of their area.

26. A packaging bag according to claim 24, wherein the back sheet is constituted by a sheet of plasticized card or a thin plate of rigid plastics material.

27. A packaging bag according to claim 24, wherein the front sheet is made of a transparent plastics material.

28. A packaging bag according to claim 24, wherein the front sheet is made by superposing a porous film and a perforated film.

29. A packaging bag according to claim 24, including multiple small-diameter perforations in the zone permeable to the product.

30. A packaging bag according to claim 24, including, in the zone permeable to the product, a material that is woven or non-woven or spongy or sintered.

31. A packaging bag according to claim 24, wherein the sheet having the zone permeable to the product is shaped to be outwardly curved when at rest.

32. A packaging bag according to claim 24, wherein the front sheet is covered prior to use by a removable protective sheet.

33. A makeup case comprising a receptacle having a bottom, wherein the receptacle houses a packaging bag as defined in claim 24, the back sheet of the packaging bag resting against said bottom.

34. A makeup case comprising a receptacle having a rigid bottom and wherein the receptacle houses a packaging bag as defined in claim 24, the back sheet of the packaging bag being flexible and resting on the rigid bottom.

35. A makeup case according to claim 34, wherein the receptacle is formed by a drawer making it possible, when the drawer is pulled out from the case, to insert or replace a packaging bag.

36. A method for applying a pasty product, comprising the steps of:

providing a packaging bag filled with said pasty product, the bag comprising at least a front sheet and a back sheet which are assembled together so as to contain said product in the form of a thin layer spread out between said sheets such that said front sheet contacts said product, the front sheet at least being flexible and also having a zone including openings that render said zone permeable to said product, the flexibility of the front sheet being selected in such a manner as to enable the front sheet to be pressed against the back sheet by means of a finger or of an applicator, thereby making it possible firstly for the user to extract product through said openings substantially without changing the size of said openings, and secondly to ensure that the bag can be emptied completely; and extracting product by pressing the front sheet against the back sheet by means of a finger or of an applicator.

37. A method for applying a pasty product, comprising the steps of:

providing a packaging bag filled with said pasty product, the bag comprising at least a front sheet and a back sheet which are assembled together so as to contain said product in the form of a thin layer spread out between said sheets such that said front sheet contacts said product, the front sheet at least being flexible and also having a zone including openings that render said zone permeable to said product, the flexibility of the front sheet being selected in such a manner as to enable the front sheet to be pressed against the back sheet by means of a finger or of an applicator, thereby making it possible firstly for the user to extract product through said openings substantially without changing the size of said openings, and secondly to ensure that the bag can be emptied completely, wherein the front sheet has, at least in the center the zone permeable to the product, said openings comprising multiple small-diameter perforations which are opened at rest; and extracting product by pressing the front sheet against the back sheet by means of a finger or an applicator.

38. A packaging bag filled with a pasty product, the bag consisting of a front sheet, a back sheet and a frame having a central opening, the front sheet and the back sheet being assembled together so as to contain the product in the form of a thin layer spread out between said sheets, the front sheet being covered by said frame, the front sheet at least being flexible and also having a zone that is permeable to the product, the flexibility of the front sheet being selected in such a manner as to enable the front sheet to be pressed against the back sheet by means of a finger or of an applicator, thereby making it possible firstly for the user to extract product, and secondly to ensure that the bag can be emptied completely.

39. A packaging bag filled with a pasty product, the bag consisting of a front sheet, a back sheet, a frame and a removable protective film fixed on said frame, the frame having a central opening, the front sheet and the back sheet being assembled together so as to contain the product in the form of a thin layer spread out between said sheets, the front sheet being covered by the frame, the front sheet at least being flexible and also having a zone that is permeable to the product, the flexibility of the front sheet being selected in such a manner as to enable it to be pressed against the back sheet by means of a finger or of an applicator, thereby making it possible firstly for the user to extract product, and secondly to ensure that the bag can be emptied completely.

40. A packaging bag filled with a pasty product, the bag comprising at least a front sheet and a back sheet which are welded together so as to contain said product in the form of a thin layer spread out between said sheets, the front sheet at least being flexible and also having a zone that is permeable to said product, the flexibility of the front sheet being selected in such a manner as to enable the front sheet to be pressed against the back sheet by means of a finger or of an applicator, thereby making it possible firstly for the user to extract product, and secondly to ensure that the bag can be emptied completely.

41. A packaging bag according to claim 40, wherein said front and back sheets are substantially plane and are assembled to each other in such a manner that after the bag has been emptied completely, the bag is plane and said sheets arc in contact with each other over a major portion of their area.

42. A packaging bag according to claim 40, wherein the back sheet is constituted by a sheet of plasticized card or a thin plate of rigid plastics material.

43. A packaging bag according to claim 40, wherein the front sheet is made of a transparent plastics material.

44. A packaging bag according to claim 40, wherein the front sheet is made by superposing a porous film and a perforated film.

45. A packaging bag according to claim 40, wherein the front sheet is covered by a mask having a central opening.

46. A packaging bag according to claim 40, wherein the mask is constituted by a rigid frame.

47. A packaging bag according to claim 46, wherein the zone permeable to the product is covered, prior to use of the bag, by a removable protective film fixed on the mask.

48. A packaging bag according to claim 40, including multiple small-diameter perforations in the zone permeable to the product.

49. A packaging bag according to claim 40, including, in the zone permeable to the product, a material that is woven or non-woven or spongy or sintered.

50. A packaging bag according to claim 40, wherein the sheet having the zone permeable to the product is shaped to be outwardly curved when at rest.

51. A packaging bag filled with a pasty product, the bag comprising at least a front sheet and a back sheet which are assembled together so as to contain said product in the form of a thin layer spread out between and contacting said sheets prior to extracting the pasty product from the bag, the front sheet at least being flexible and also having a zone including permanently open through holes that render the zone permeable to said product, the flexibility of the front sheet being selected in such a manner as to enable the front sheet to be pressed against the back sheet by means of a finger or of an applicator, thereby making it possible firstly for the user to extract product, and secondly to ensure that the bag can be emptied completely.

52. A packaging bag according to claim 51, wherein said front and back sheets are substantially plane and are assembled to each other in such a manner that after the bag has been emptied completely, the bag is plane and said sheets are in contact with each other over a major portion of their area.

53. A packaging bag according to claim 51, wherein the back sheet is constituted by a sheet of plasticized card or a thin plate of rigid plastics material.

54. A packaging bag according to claim 51, wherein the front sheet is made of a transparent plastics material.

55. A packaging bag according to claim 51, wherein the front sheet is made by superposing a porous film and a perforated film.

56. A packaging bag according to claim 51, wherein the front sheet is covered by a mask having a central opening.

57. A packaging bag according to claim 56, wherein the mask is constituted by a rigid frame.

58. A packaging bag according to claim 57, wherein the zone permeable to the product is covered, prior to use of the bag, by a removable protective film fixed on the mask.

59. A packaging bag according to claim 51, including multiple small-diameter perforations in the zone permeable to the product.

60. A packaging bag according to claim 51, including, in the zone permeable to the product, a material that is woven or non-woven or spongy or sintered.

61. A packaging bag according to claim 51, wherein the sheet having the zone permeable to the product is shaped to be outwardly curved when at rest.

62. A packaging bag filled with a pasty product, the bag comprising at least a front sheet and a back sheet which are substantially planar and are assembled together so as to contain said pasty product in the form of a thin layer spread out between said front and back sheets such that said front sheets contacts said pasty product, said front sheet being flexible and also having a zone including openings that render said zone permeable to said pasty product, the flexibility of said front sheet being selected in such a manner as to enable said front sheet to be pressed against said back sheet by means of a finger or of an applicator, thereby making it possible firstly for the user to extract said pasty product through said openings, and secondly to ensure that the volume of the bag can be reduced to zero so the bag can be emptied completely, said front and back sheets being substantially in contact over their entire surface when the bag is empty.

* * * * *